US009822743B2

(12) United States Patent
Oliver

(10) Patent No.: US 9,822,743 B2
(45) Date of Patent: Nov. 21, 2017

(54) PORTABLE FUEL TANK ASSEMBLY FIXTURE

(71) Applicant: Honda Motor Co., Ltd., Tokyo (JP)

(72) Inventor: Jonathan F. Oliver, Florence, SC (US)

(73) Assignee: Honda Motor Co., Ltd., Tokyo (JP)

( * ) Notice: Subject to any disclaimer, the term of this patent is extended or adjusted under 35 U.S.C. 154(b) by 919 days.

(21) Appl. No.: 14/207,744

(22) Filed: Mar. 13, 2014

(65) Prior Publication Data

US 2015/0260132 A1 Sep. 17, 2015

(51) Int. Cl.
*F02M 37/00* (2006.01)

(52) U.S. Cl.
CPC .... *F02M 37/0011* (2013.01); *Y10T 29/49826* (2015.01); *Y10T 29/53961* (2015.01)

(58) Field of Classification Search
CPC ..... B25B 11/00; B25B 1/00; B23P 11/00
See application file for complete search history.

(56) References Cited

U.S. PATENT DOCUMENTS 2,734,824 A 2/1956 De Luca
2,916,143 A 12/1959 Mcconalogue
3,090,115 A 5/1963 Carr
3,136,007 A 6/1964 Maher et al.
4,395,818 A * 8/1983 Jackson ..... H01R 43/20 29/747
5,052,096 A 10/1991 Fuller et al.
5,191,689 A 3/1993 Slesinski et al.
5,203,073 A * 4/1993 Kotake ..... B62D 65/02 29/771
5,221,019 A 6/1993 Pechacek et al.
5,839,181 A * 11/1998 Chu ..... B25B 11/02 29/281.5
6,233,980 B1 5/2001 Kegler et al.
8,678,219 B1 * 3/2014 Wang ..... B65F 1/163 220/211
2015/0260132 A1 * 9/2015 Oliver ..... F02M 37/0011 29/428

* cited by examiner

*Primary Examiner* — Lee D Wilson
(74) *Attorney, Agent, or Firm* — Rankin, Hill & Clark LLP

(57) ABSTRACT

A portable fixture for assembling a vehicle fuel tank includes a frame including a platform having a fuel tank locator mounted thereon for at least partially receiving and supporting an associated fuel tank for assembly. A lid is connected to the frame and is movable between a raised position and a lowered position. A locking device is located on the lid and includes at least one engagement member for engaging a part of an associated lock ring for securing an associated fuel pump in the associated fuel tank. The locking device is operable to automatically move from a first position to a second position for rotating the associated lock ring to a locked state. A stop mechanism is operably connected to the locking device to automatically stop movement of the locking device at the second position to prevent over tightening of the associated lock ring.

20 Claims, 10 Drawing Sheets

PORTABLE FUEL TANK ASSEMBLY FIXTURE

BACKGROUND

It is known for vehicle fuel tanks to include internal fuel pumps which are mounted in a fuel pump opening located on the fuel tank. One manner to secure the fuel pump in the fuel tank is to manually fasten a flange portion formed on an end of the fuel pump with a flange portion formed on the fuel tank using a fastener. Another manner to secure the fuel pump in the fuel tank is by the use of a metal lock ring insert having a retaining lock ring. Typically, the lock ring is locked manually using a T-bar or similar device that is configured to engage the lock ring. However, this requires excessive force to be applied by an associate on the T-bar to rotate the lock ring to its locked position.

BRIEF DESCRIPTION

In accordance with one aspect, a portable fixture for assembling a vehicle fuel tank comprises a frame including a platform having a fuel tank locator mounted thereon for at least partially receiving and supporting an associated fuel tank for assembly. A lid is connected to the frame and is movable between a raised position and a lowered position. A locking device is located on the lid and includes at least one engagement member for engaging a part of an associated lock ring for securing an associated fuel pump in the associated fuel tank. The locking device is operable to automatically move from a first position to a second position for rotating the associated lock ring to a locked state. A stop mechanism is operably connected to the locking device to automatically stop movement of the locking device at the second position to prevent over tightening of the associated lock ring.

In accordance with another aspect, a system for assembling a vehicle fuel tank comprises a fixture including a frame having a fuel tank locator mounted thereto. The fuel tank locator is configured to receive a vehicle fuel tank in an unassembled condition. A fuel pump is inserted into a fuel pump opening located on the fuel tank. A lock ring is positioned over both the inserted fuel pump and at least two locking tabs formed on the fuel tank and circumferentially spaced about the fuel pump opening. A locking device is provided on the fixture and movable to a position over the lock ring. The locking device is configured to engage the lock ring. A drive mechanism coupled to the locking device is operable to move the locking device from a first position to a second position, and movement of the locking device rotates the lock ring to a locked state on the fuel tank. A stop mechanism is operably connected to the drive mechanism and configured to automatically stop operation the drive mechanism when the locking device is in the second position to prevent the locking device from over tightening the lock ring on the fuel tank.

In accordance with yet another aspect, a method of assembling a fuel tank on a fixture comprises placing a fuel tank on a fuel tank locator located on the fixture; inserting a fuel pump into an fuel pump opening located on a top wall of the fuel tank; positioning a lock ring over both the inserted fuel pump and at least two locking tabs formed on the fuel tank and circumferentially spaced about the fuel pump opening; positioning a locking device of the fixture over the lock ring, the locking device having at least one engagement member for engaging a part of the lock ring; and automatically rotating the engagement member of the locking device to move the lock ring engaged thereto to a locked state on the fuel tank.

DETAILED DESCRIPTION

Figure 1:
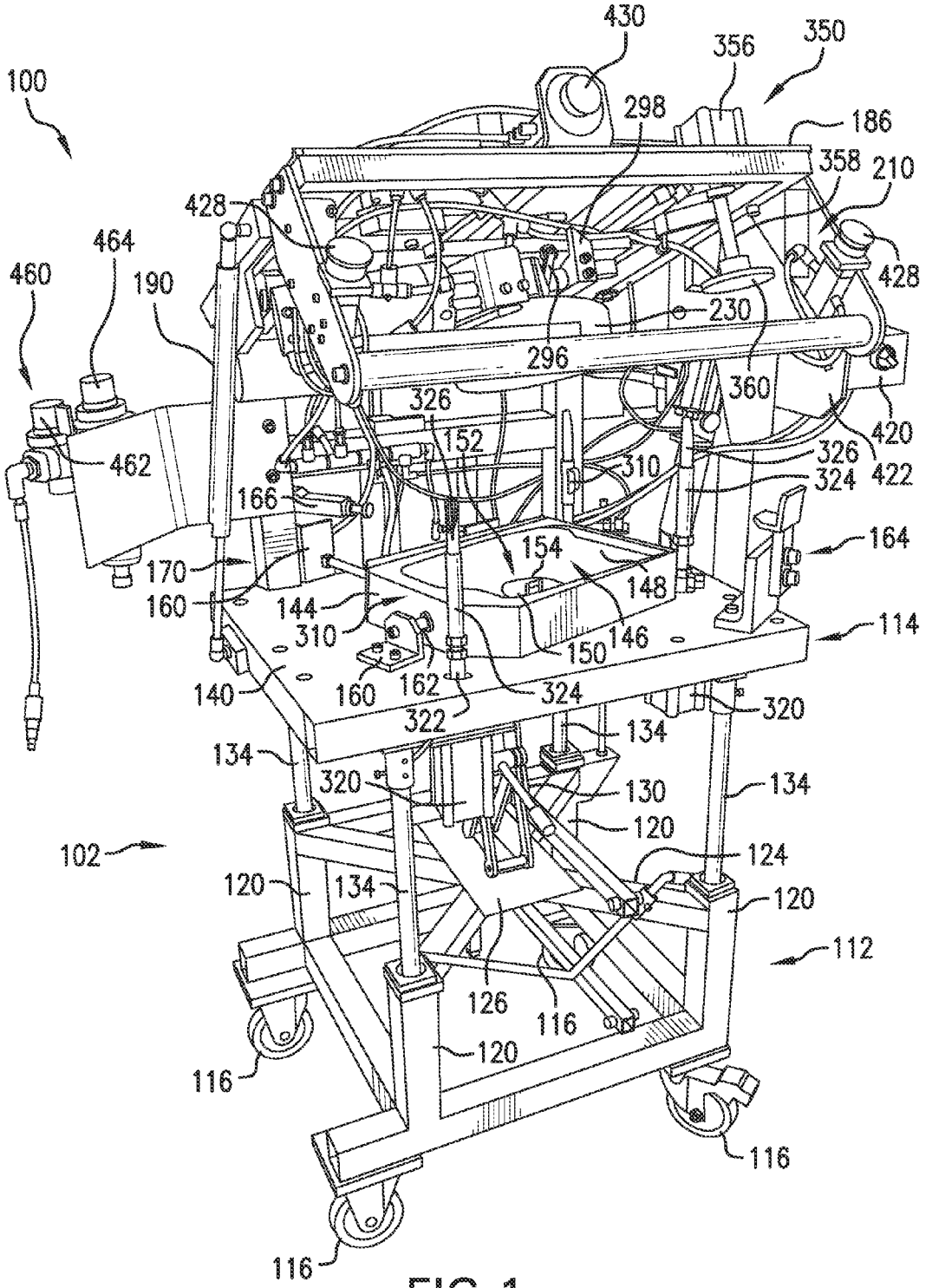
FIG. 1 is a front perspective view of a portable fixture for assembling a vehicle fuel tank according to the present disclosure.

It should, of course, be understood that the description and drawings herein are merely illustrative and that various modifications and changes can be made in the structures disclosed without departing from the present disclosure. In general, the figures of the exemplary portable fuel tank assembly fixture are not to scale. It will also be appreciated that the various identified components of the exemplary portable pneumatic fuel tank assembly fixture disclosed herein are merely terms of art that may vary from one manufacturer to another and should not be deemed to limit the present disclosure.

Referring now to the drawings, wherein like numerals refer to like parts throughout the several views, FIGS. 1-4 illustrate a portable fixture 100 for assembling a vehicle fuel tank 102 (FIG. 6B) according to the present disclosure. The fixture 100 includes a frame 110 having a lower frame base 112 and an upper frame base 114. The lower frame base 112 can include wheels or casters 116 which allows for the portable manner of the fixture 100. Lower uprights 120 extend from the lower frame base 112 toward the upper frame base 114, and secured to the lower uprights 120 is a cross bracing 124. A mount 126 is centrally located on the cross bracing 124 and a scissor jack 130 is secured to the mount 126. The frame 110 further includes retractable linear shafts 134 extending outwardly from end portions of the lower uprights 120 for interconnecting the lower frame base 112 and the upper frame base 114. With this arrangement, the scissor jack 130 can selectively raise and lower the upper frame base 114 relative to the lower frame base 112. A platform 140 is secured to the upper frame base 114.

A fuel tank locator or stabilizer 144 is positioned on the platform 140. The locator 144 has a cavity 146 sized and shaped to at least partially receive and support the fuel tank 102 in an unassembled condition for assembly by the fixture 100. A surface 148 of the locator 144 that defines the cavity 146 includes an opening 150. At least partially projecting through the opening 150 is a fuel tank indicator 152 operable to provide confirmation to an operator that the fuel tank 102 is properly installed in the locator 144. According to one aspect, the indicator is a mechanical valve 154 having a roller lever 156 (FIG. 6A) for engaging the fuel tank 102; although, it should be appreciated that alternative configurations for the fuel tank indicator 152 are contemplated.

Supports 160 are secured to the platform 140 adjacent the locator 144. Each of the supports 160 includes an adjustable elongated member 162 having an end abutting the locator 144. The supports 160 together with the elongated members 162 ensure that the locator 144 does not shift or move on the platform 140 during assembly of the fuel tank 102 by the fixture 100. A front fuel tank brace 164 and a rear adjustable fuel tank brace 166 for further supporting the fuel tank 102 while in the locator 144 can be mounted to the platform 140.

Figure 4:
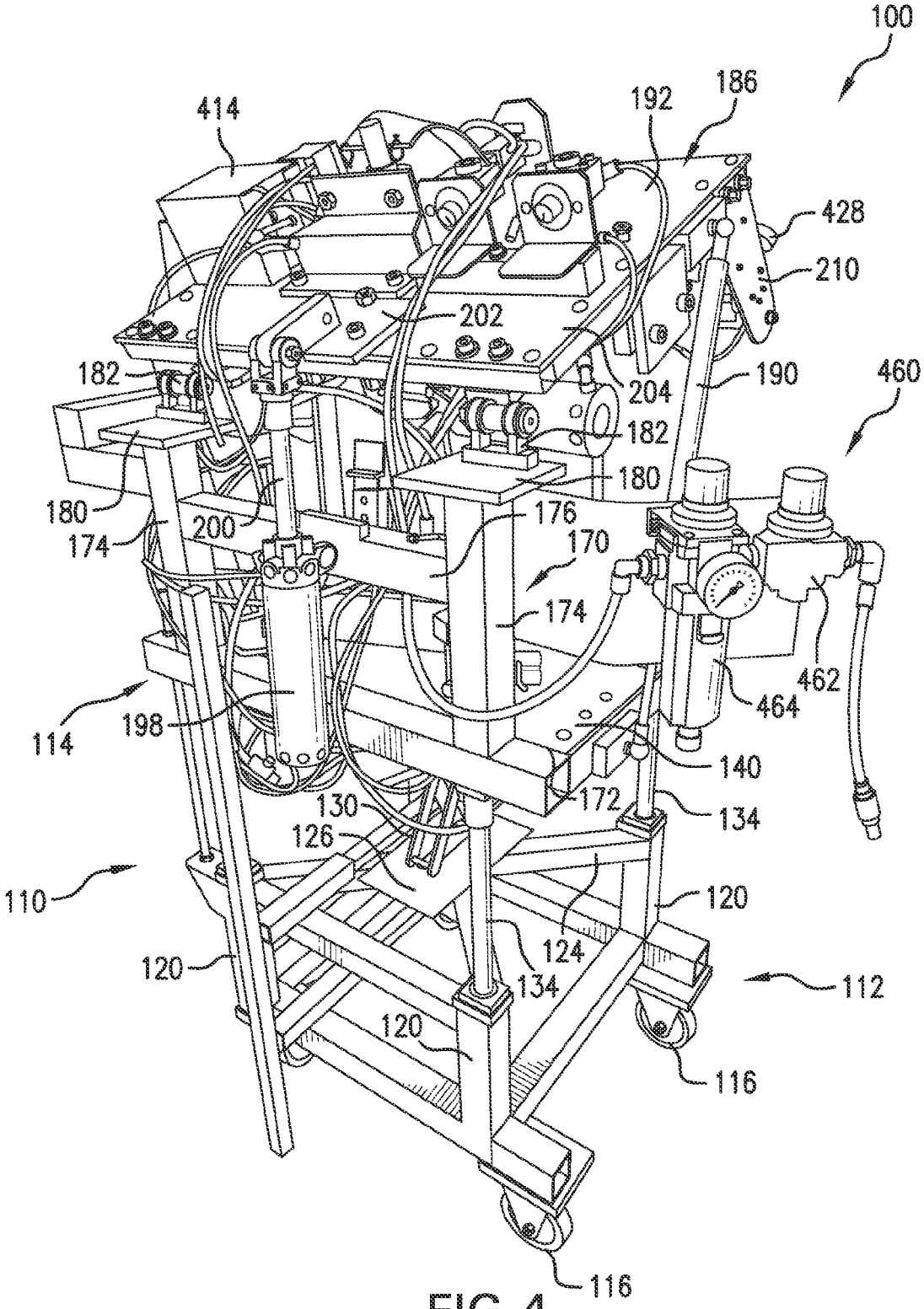
FIG. 4 is a rear perspective view of the fixture of FIG. 1.

As best depicted in FIG. 4, the frame 110 further includes an upright assembly 170 mounted to the upper frame base 114 and located along a side 172 of the platform 140. The upright assembly 170 includes a pair of upper uprights 174 and a cross member 176 interconnecting the upper uprights 174. Hinge mounts 180 are secured to the upper uprights 174 and hinges 182 are fixed to the hinge mounts 180. A lid 186 is connected to the hinges 182 and is movable between a raised position and a lowered position where the lid 186 covers the platform 140. A pneumatic spring 190 connects a front portion 192 of the lid 186 to the upper frame base 114. It should be appreciated that the pneumatic spring 190 provides a counterbalance for the lid 186 and holds the lid 186 in its raised position. A lid assist pneumatic actuator or piston 198 is connected to the upright assembly 170 and is operable to automatically move the lid 186 from its raised position to its lowered position. A piston arm 200 of the actuator 198 is hingedly connected to a hinge plate 202 attached to a rear portion 204 of the lid 186. A handle assembly 210 can be attached to the front portion 192 of the lid 186.

Figure 2:
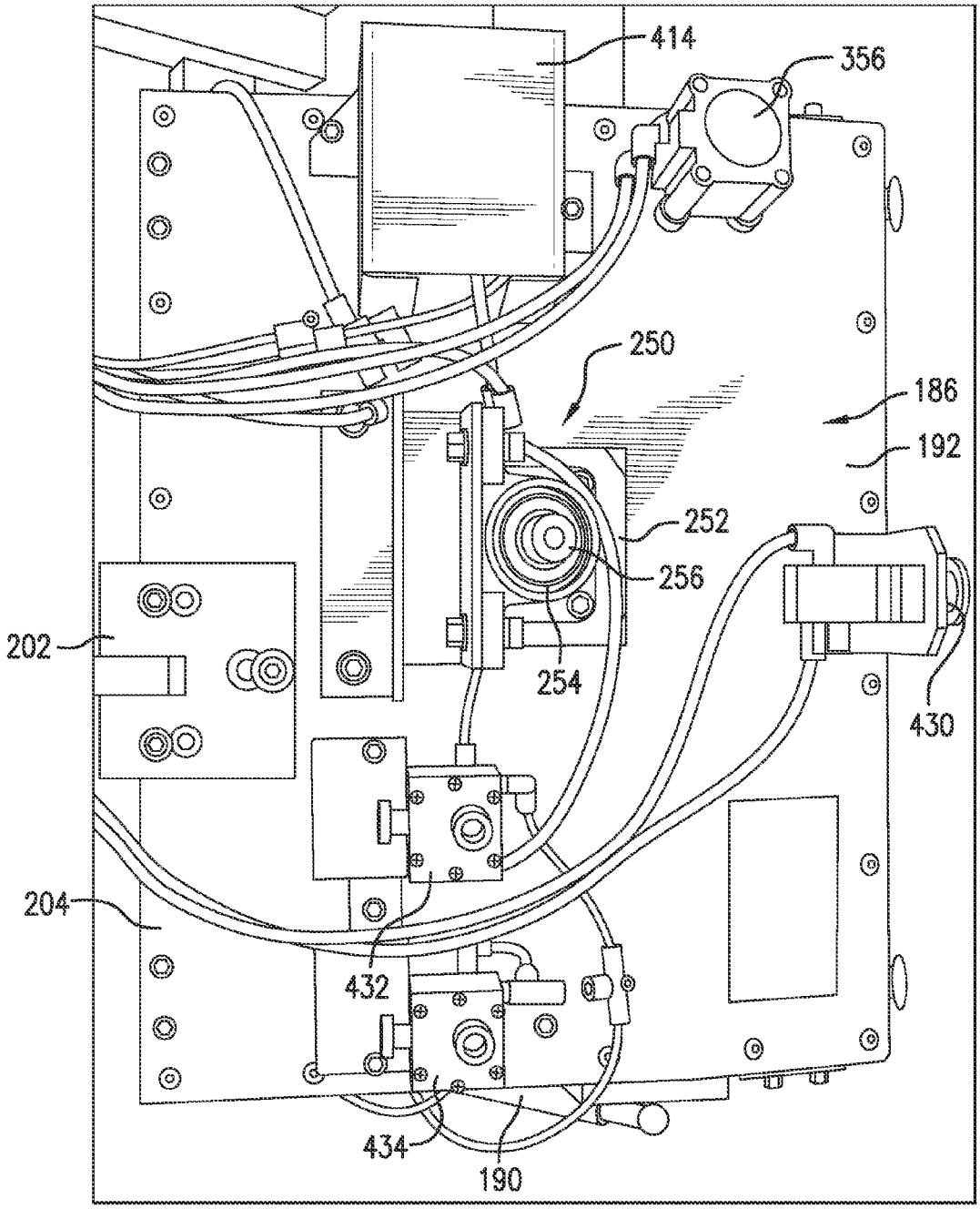
FIG. 2 is a top perspective view of a lid of the fixture of FIG. 1.
Figure 3:
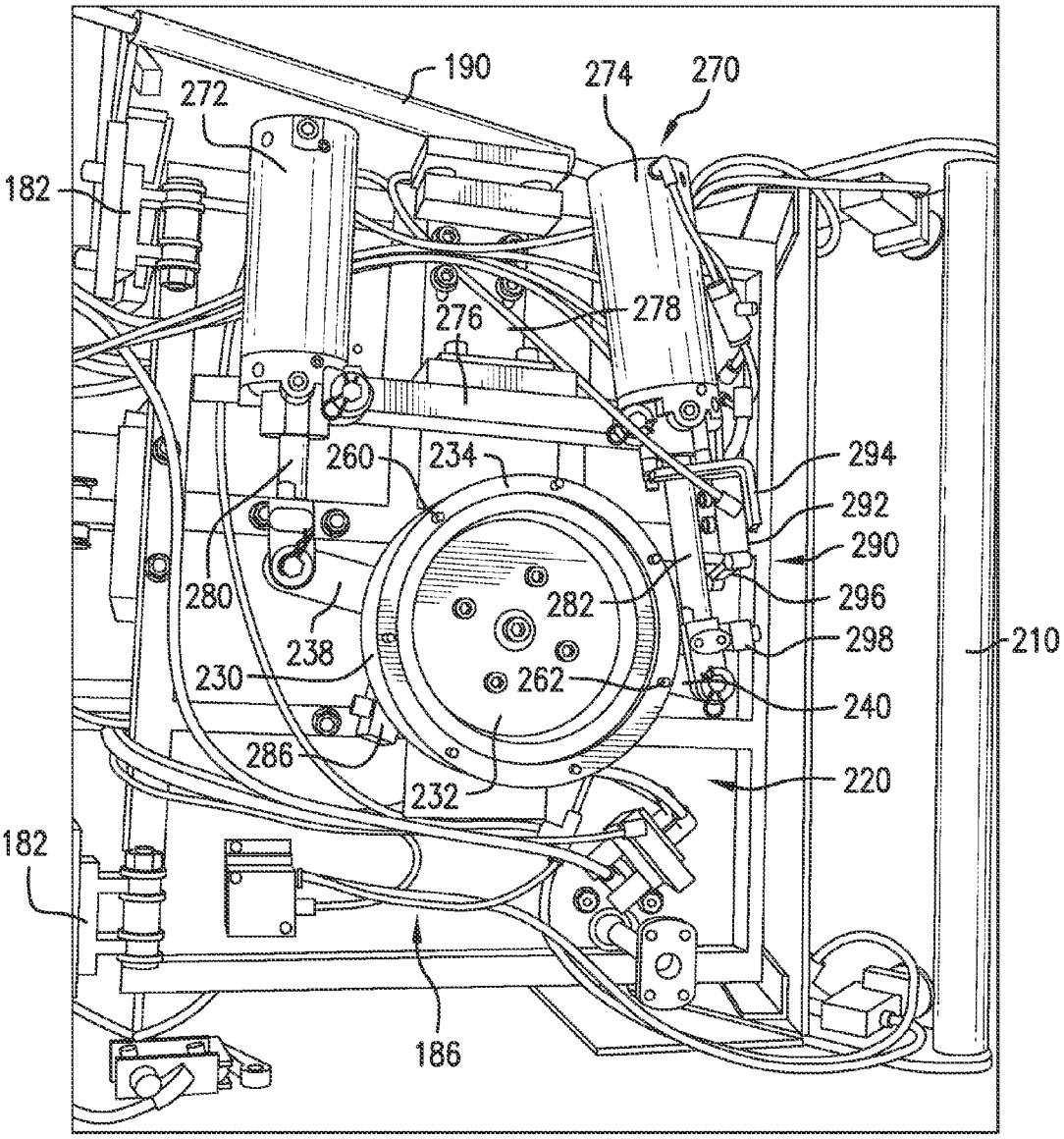
FIG. 3 is a bottom perspective view of the lid of FIG. 2 illustrating an exemplary locking device and a drive mechanism for actuating the locking device.

With reference to FIGS. 1-3, a locking device 220 is located on an underside of the lid 186. The locking device 220 includes at least one engagement member for engaging a part of a lock ring 224 (FIGS. 6E and 6F). The lock ring 224 is positioned on a fuel pump 226 (FIG. 6D) inserted into a fuel pump opening 228 located on the fuel tank 102. The locking device 220 is operable to automatically rotate the lock ring 224 to a locked state which secures the fuel pump 226 to the fuel tank 102. Particularly, according to one aspect, the locking device 220 includes a rotatable lock cup 230 having a base 232 and a side wall 234. The side wall 234 can be cylindrical shaped and is sized to at least partially fit over the lock ring 224. At least one finger 238 extends outwardly from the lock cup 230, and in the depicted embodiment the at least one finger 238 is a first finger, and the locking device 220 further includes a second finger 240. The second finger 240 is spaced from the first finger 238 and also extends outwardly from the lock cup 230. With reference to FIG. 2, a bearing assembly 250 rotatably attaches the lock cup 230 to the lid 186. In the depicted embodiment, the bearing assembly 250 includes a mounting plate 252 secured to the lid 186, and a bearing 254 for supporting one end of a rotary shaft 256 is mounted to the plate 252. The other end of the rotary shaft is mounted to an adaptor bushing (not visible) attached to the base 232 of the lock cup 230. The rotary shaft 256 defines a rotational axis of the lock cup 230.

As shown, the lock cup 230 includes the at least one engagement member for engaging the lock ring 224. According to one aspect, and with reference back to FIG. 3, the at least one engagement member is a first engagement member 260 and a second engagement member 262 spaced from the first engagement member. Each of the first and second engagement members 260, 262 projects outwardly from the lock cup 230 in a direction parallel to the rotational axis of the lock cup 230. In the illustrated embodiment, the first and second engagement members 260, 262 are defined by pins extending outwardly from the side wall 234. It should be appreciated that the lock cup 230 can includes a plurality of spaced pins as depicted in FIG. 3; although, this is not required. In operation, and as will be described below, when the lid 186 is moved to its lowered position, the lock cup 230 is located over the lock ring 224 on the fuel tank 102. The pins 260, 262 are received in corresponding cutouts 266 provided on the lock ring 224 wherein rotation of the lock cup 230 from a first position to a predetermined second position simultaneously rotates the lock ring 224 to its locked state.

A drive mechanism 270, which can be attached to the lid 186, is coupled to the locking device 220 and is operable to rotate the lock cup 230 from its first position to its second position. As shown in FIG. 3, the drive mechanism 270 includes a first actuator 272 and a separate second actuator 274. A pair of mounting brackets 276, 278 secures the first and second actuators to the lid 186. Each of the first and second actuators 272, 274 is connected to the lock cup 230 and has a first operational state and a second operational state. To allow for rotation of the lock cup 230, when the first actuator 272 is in one of its first and second operational states the second actuator is in the other of its first and second operational states. Particularly, the first actuator 272 is a first pneumatic piston having a first piston arm 280 connected to the first finger 238 of the lock cup 230. The second actuator 274 is a second pneumatic piston having a second piston arm 282 connected to the second finger 240 of lock cup 230. The first operational state of each of the first and second pistons 272, 274 is a retracted position of its respective piston arm 280, 282 and the second operational state of each of the first and second pistons 272, 274 is an extended position of its respective piston arm 280, 282. In FIG. 3, the first piston 272 is in the first operational state and the second piston 274 is in the second operational state. With the arrangement of the depicted first and second actuators, as the first piston 272 moves to the second operational state (i.e., the extended position of the first piston arm 280) and the second piston 274 moves to the first operational state (i.e., the retracted position of the second piston arm 282), the lock cup 230 rotates or shifts about is rotational axis.

It should be appreciated that the angular displacement of the lock cup 230, and, in turn, the angular displacement of the lock ring 224, is at least partially controlled by the location of the first and second fingers 238, 240 on the lock cup 230 and a length of each of the first and second piston arms 280, 282. The lock cup 230 can be provided with a stop block (not visible), a safety stop block 286 having an adjustable advance stopper, and a return stop block (not visible) having an adjustable return stopper. The safety stopper of the block 286 can serve as a hard stop that engages the stop block to stop rotation of the lock cup 230 during tightening of the lock ring 224 on the fuel tank 102. The return stopper also serves as a hard stop that engages the stop block to locate a return position of the lock cup 230 after a cycle end reset of the locking device 220. To further prevent over tightening of the lock ring 224, a stop mechanism 290 is operably connected to one of the first and second actuators 272, 274 to automatically stop operation of the locking device 220 when the lock cup 230 is at its second position. In the depicted embodiment of FIG. 3, the stop mechanism 290 includes a lock cup advanced mechanical valve 292 operably connected to the second actuator 274. A mount 294 secures the mechanical valve 292 to the lid 186. According to one aspect, the mechanical valve 292 includes an indicator or roller lever 296. A stop 298 is connected to one of the second finger 240 and the end of the second piston arm 282. As the second piston arm 282 is retracted to its second operational state (which moves the lock cup 230 to its locked second position, and, in turn, the lock ring 224 to its locked state), the stop 298 engages the roller lever 296 and actuates the mechanical valve 292. Actuation of the mechanical valve 292 provides a pneumatic signal to stop the supply of pneumatic pressure to that first and second actuators 270, 272 which automatically stops the drive mechanism 270.

With reference back to FIG. 1, the exemplary fixture 100 further includes at least one retractable grommet installer 310 located on the platform 140 adjacent the fuel tank locator. As shown, the fixture 100 is provided with three retractable installers 310, each installer 310 being configured to automatically secure a grommet 312 in a mounting hole 314 of the fuel tank 102 (see FIG. 6B). Each installer 310 includes a pneumatic actuator or piston 320 mounted to the upper frame base 114 beneath the platform 140. The piston 320 includes a piston arm 322 extending through an opening located in the platform 140. Mounted to an end of the piston arm 322 is a first elongated member 324 and a second elongated member 326 telescopically received in the first member 324 and directly attached to the piston arm 322. This allows the second member 326 to move with the piston arm 322 between an extended position shown in FIG. 1 and a retracted position. As shown in FIG. 6B, an end portion of the second member 326 is configured to extend through the mounting hole 314 and have the grommet 312 mounted thereto. In operation, as the second member 326 retracts (via the piston arm 322) the grommet 312 is pulled into the mounting hole 314 and is retained in the mounting hole. It should be appreciated that the retractable installers 310 also define a locating feature on the platform 140 of the frame 100 to properly position the fuel tank 102 on the fuel tank locator 144 prior to actuation of the locking device 220.

Figure 5A:
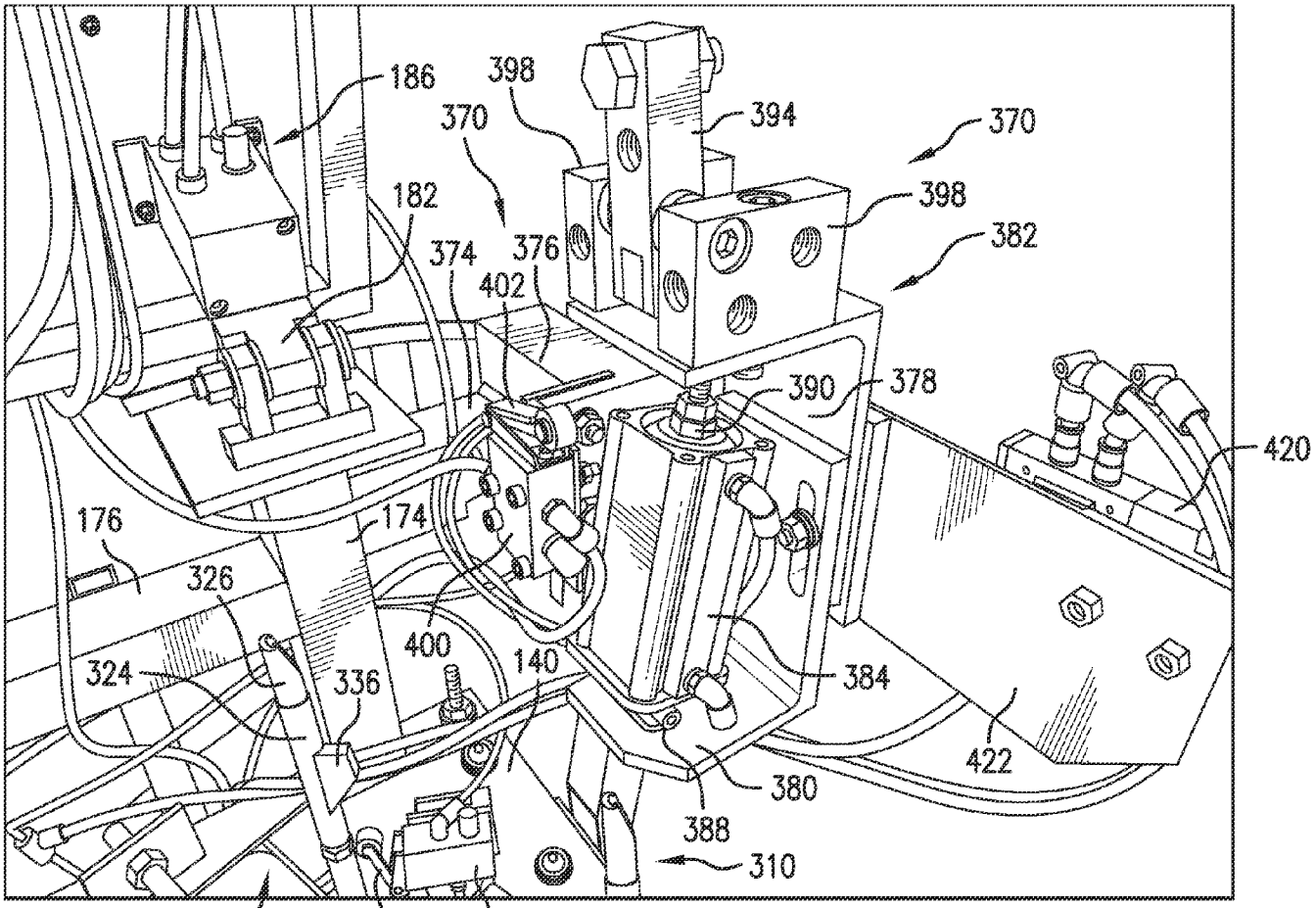
FIGS. 5A through 5C are perspective views of a lid lock assembly of the fixture of FIG. 1.

FIG. 5A depicts an indicator 330 associated with one of the grommet installers 310 and operable to confirm that the grommet installer 310 is in its retracted position. The indicator 330 is mounted to the platform 140 and can include a mechanical valve 332 having a roller lever 334. The one grommet installer 310 is provided with a tab 336 on its first member 324 for contacting the roller lever 334. As the grommet installer 310 moves to its retracted position, the tab 336 engages the roller lever 334 of the mechanical valve 332. Actuation of the mechanical valve 332 can provide a pneumatic signal that the grommet installer 310 is in the retracted position (which confirms that the grommet 312 is installed in the mounting hole 314), and that the drive mechanism 270 can be actuated to rotate the locking device 220 to move the lock ring 224 to its locked state on the fuel tank 102.

Further provided on the exemplary fixture 100 is an automated plate level installer 350. The plate level installer 350 is mounted to the lid 186 and operable to push a plate level 352 (FIG. 6E) in proper position in a fuel cap opening 354 of the fuel tank 102. In the depicted embodiment, the plate level installer 350 includes an actuator or piston 356 having a retractable piston arm 358. Mounted on an end portion of the piston arm 358 is a plate or plunger 360. The plate 360 is sized and shaped to engage the plate level 352 and push the plate level into the opening 354 upon actuation of the piston 356. An indicator (not shown) can be provided on the lid 186 for confirming that the plate level installer 350 is in its retracted position after installation of the plate level 352 on the fuel tank 102.

Figure 5B:
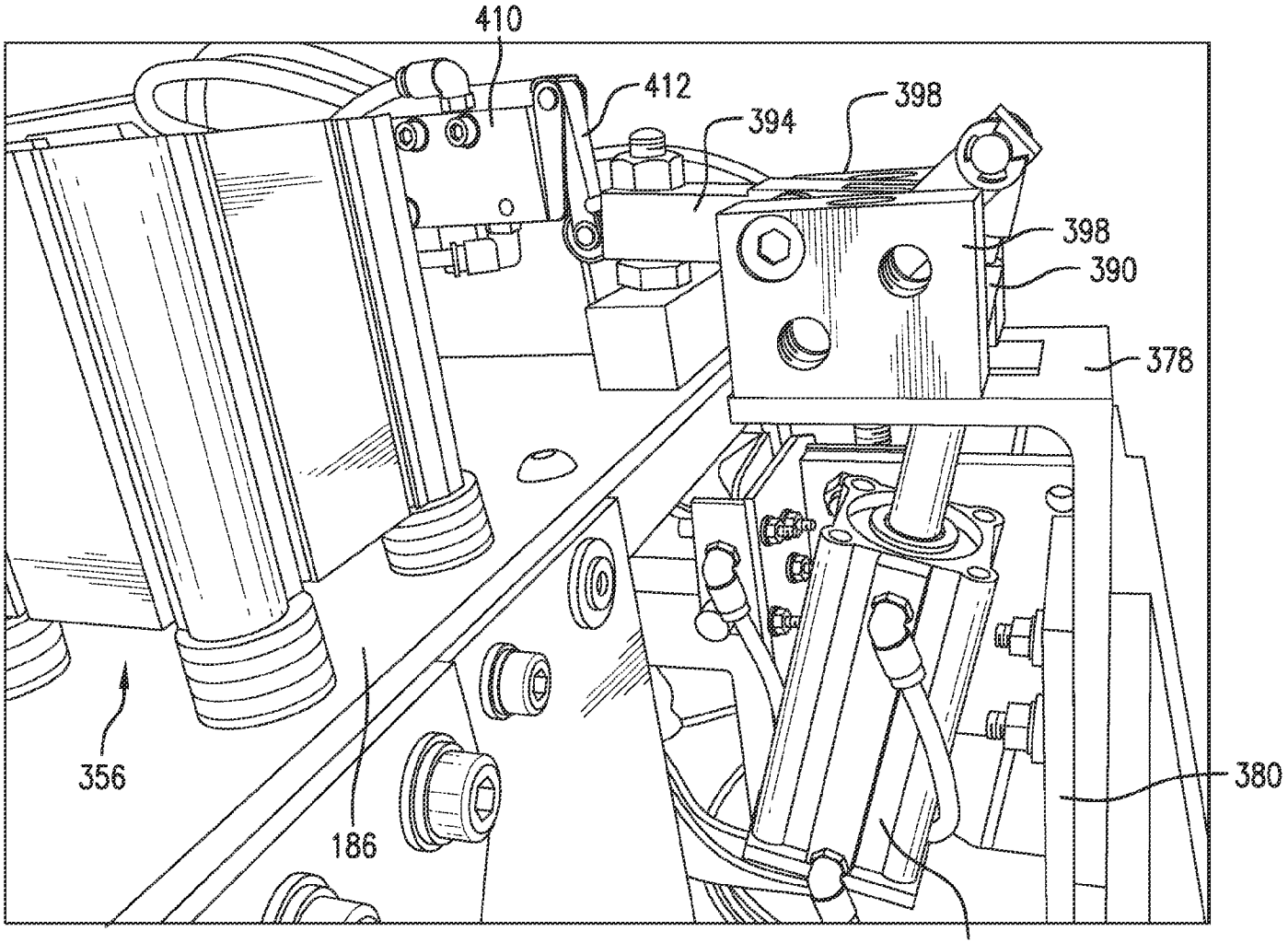
Figure 5C:
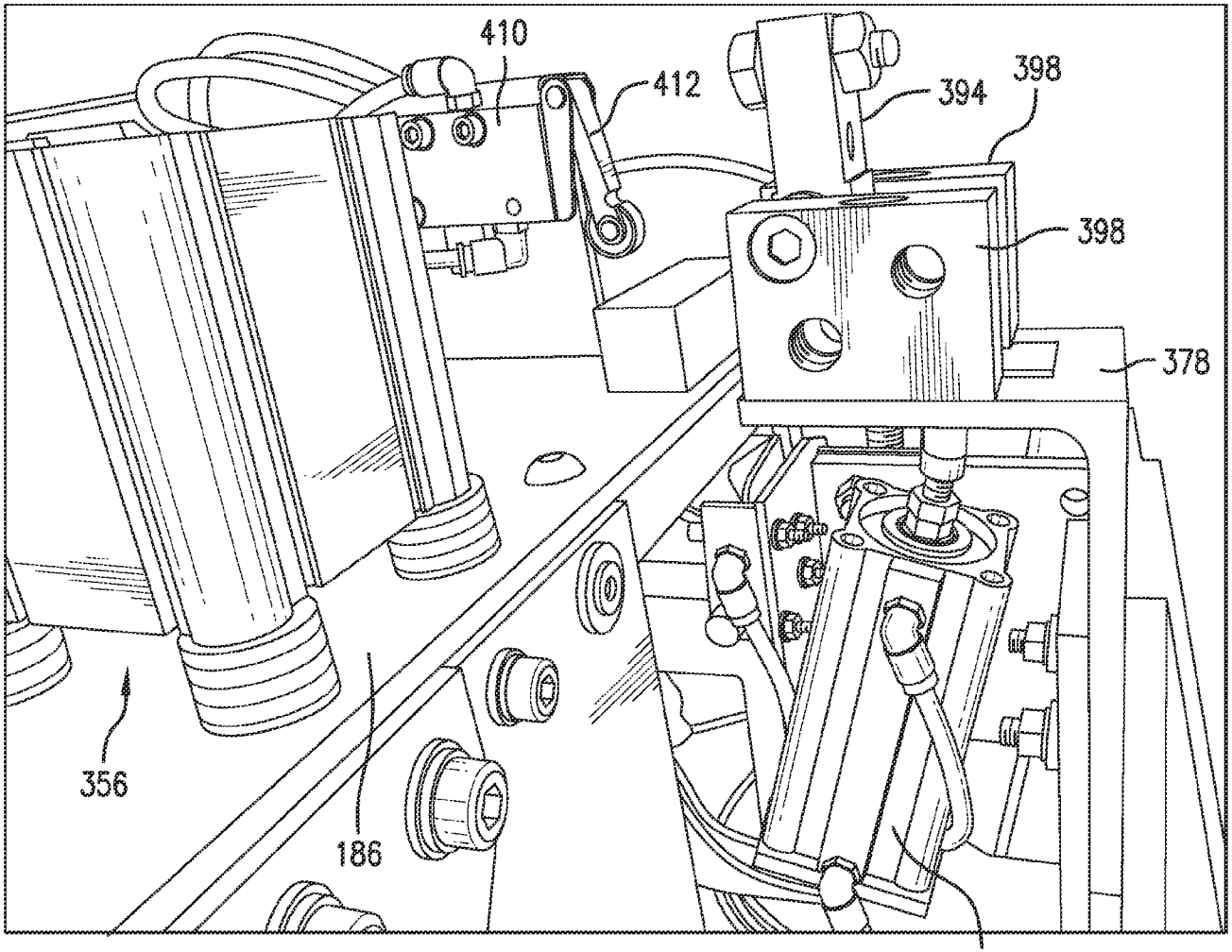

With reference now to FIGS. 5A, 5B and 5C, the fixture 100 further comprises a lid lock mechanism 370 operable to lock the lid 186 in its lowered position, which locks the locking device 220 in position over the lock ring 224. A first mount 372 for the lid lock mechanism has a first part 374 secured to the upright assembly 174 and a second part 376 extending perpendicularly from the first part so as to be positioned on a side of the fixture 100 opposite the gas spring 190. A second mount 378 is fixed to an end of the second part 376 and a third mount 380 is attached to the second mount. Each of the second mount 378 and third mount 380 can be L-shaped so that when connected the mounts 378, 380 at least partially define a housing 382. A lid lock actuator or piston 384 is secured in the housing 382 via a hinge 388. An arm 390 of the piston 384 selectively engages a link bar 394. The link bar 394 is pivotally connected to a pair of link bar mounts 398 secured to the second mount 378. A first mechanical valve 400 having a first roller lever 402 is connected to the first mount 372 beneath the link bar 394. As indicated previously, the fuel tank indicator 152 is operable to provide confirmation to an operator that the fuel tank 102 is properly installed in the locator 144, and actuation of the mechanical valve 154 of the indicator 152 enables the first mechanical valve 400. A second mechanical valve 410 having a second roller lever 412 is mounted to the lid 186 adjacent the actuator 356. A cover 414 can be provided over the second mechanical valve 410 (FIG. 2). A raise/lower lid switch 420 can be mounted on a support 422 attached to the second mount 378. In operation, moving the lid 186 to its lowered position engages the first roller lever 402 and actuates the first mechanical valve 400. Because the first mechanical valve 400 was enabled by the mechanical valve 154, actuation of the first mechanical valve 400 sends a pneumatic signal to supply pneumatic pressure to the piston 384 to extend the piston arm 390. The extended piston arm 390 engages the link bar 394 causing the link bar to pivot into engagement with the second roller lever 412. The second mechanical valve 410 is actuated and a pneumatic signal is sent to continue the supply of pneumatic pressure to the lid assist actuator 198 to maintain the piston arm 200 in the extending position, which maintains the lid 186 in its lowered position.

With reference to FIGS. 1-3, a pair of cycle start buttons 428 can be mounted to the handle assembly 210 and an emergency stop button 430 can be mounted to the front portion 192 of the lid 186. A timer 432 for the lid lock mechanism 370 and a timer 434 for the plate level installer 350 can also be mounted to the lid 186. A pressure relief assembly 460 can be mounted to the frame 110 and includes a pressure relief on/off locking valve 462 and a filter/regulator 464.

Figure 6A:
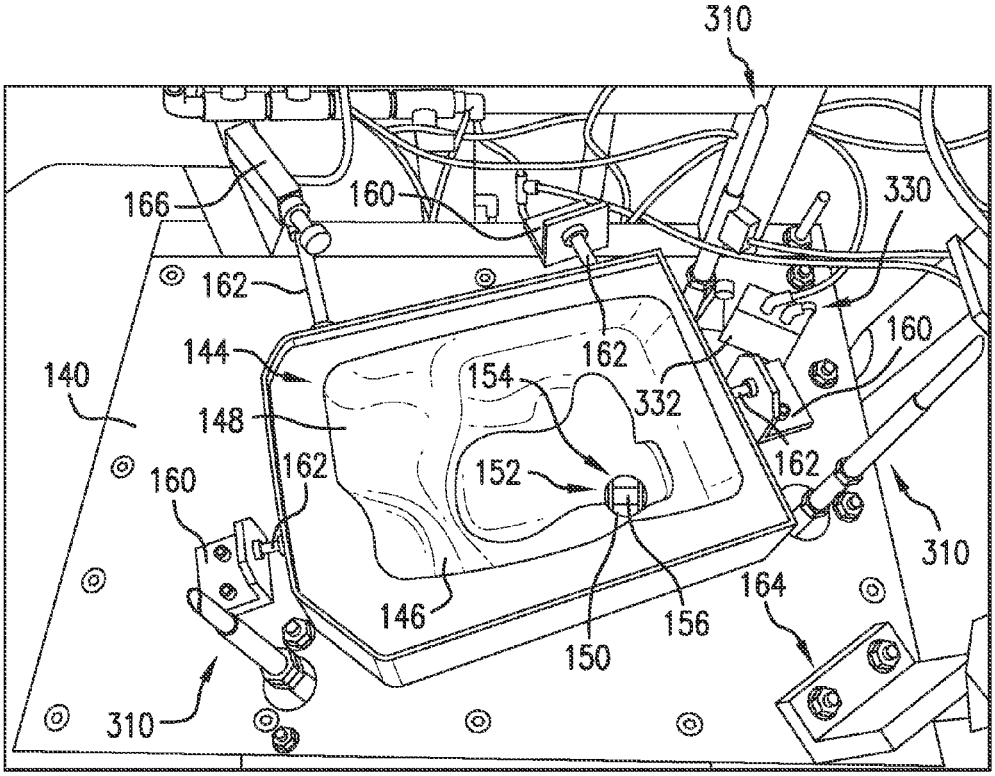
FIGS. 6A through 6F depict the fuel tank being positioned on a locator of the fixture and the assembly of components on the fuel tank prior to actuation of the locking device of FIG. 3.
Figure 6B:
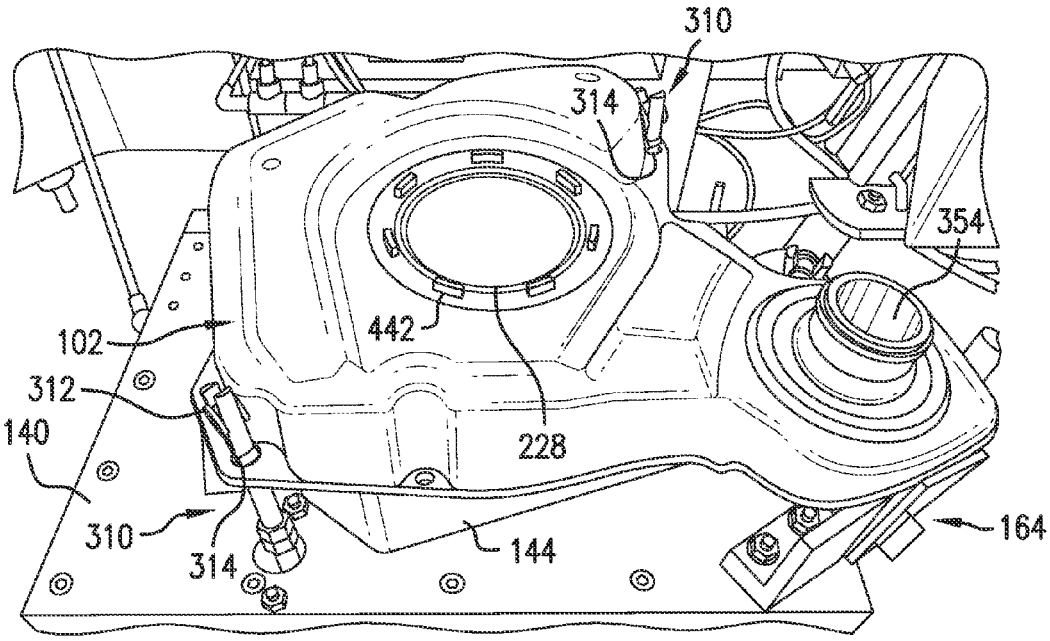
Figure 6C:
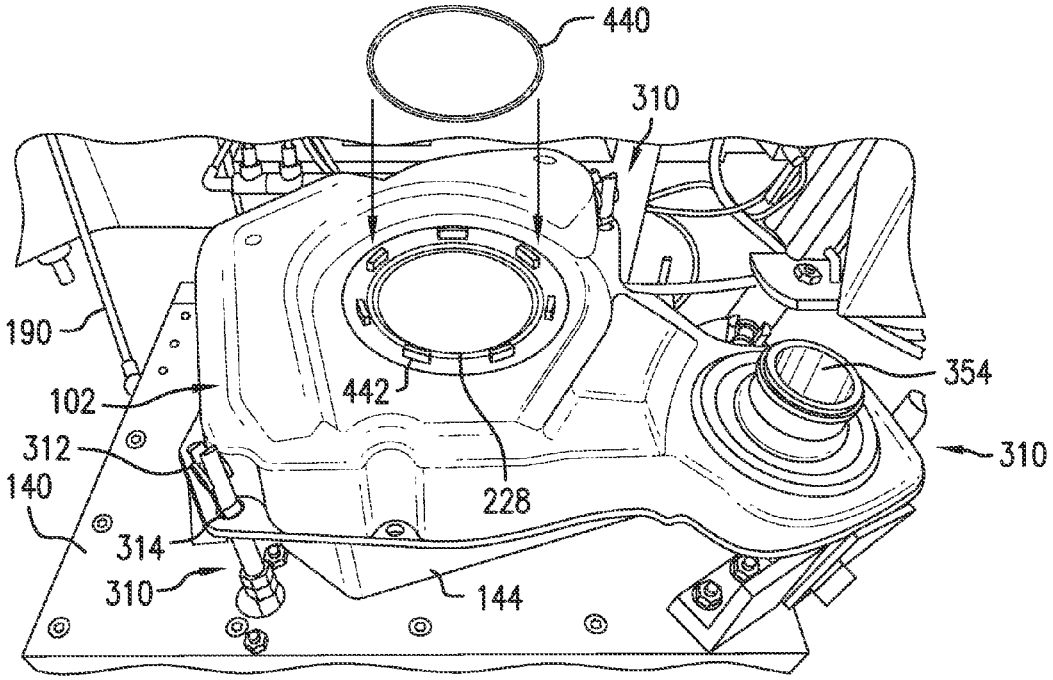
Figure 6D:
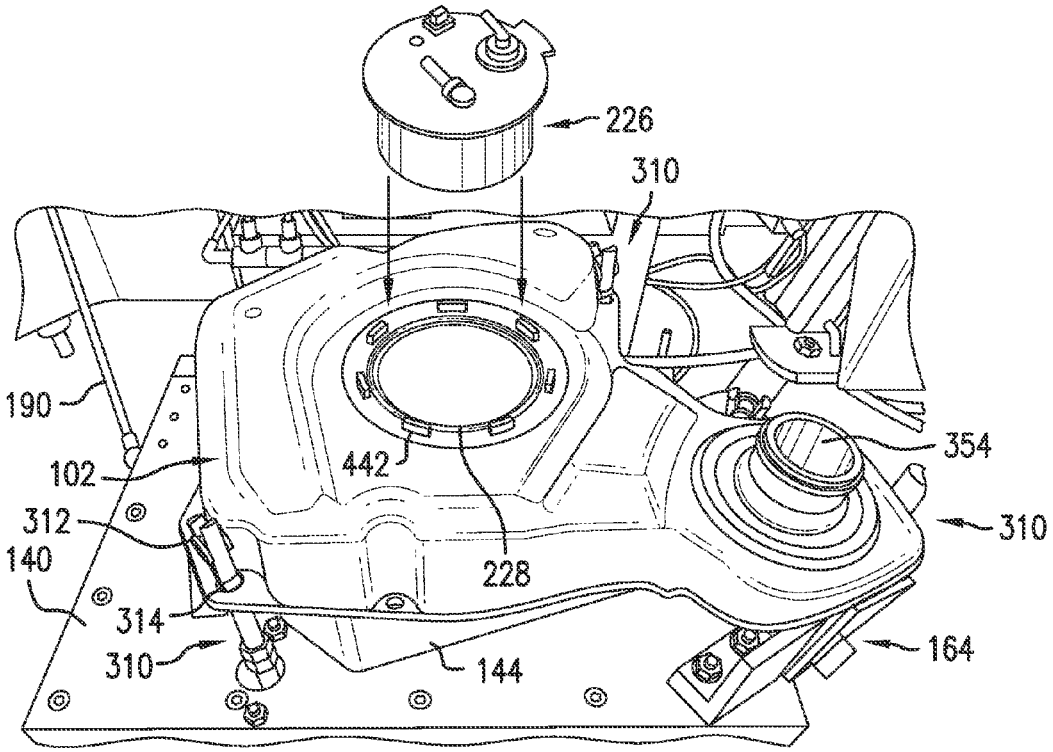
Figure 6E:
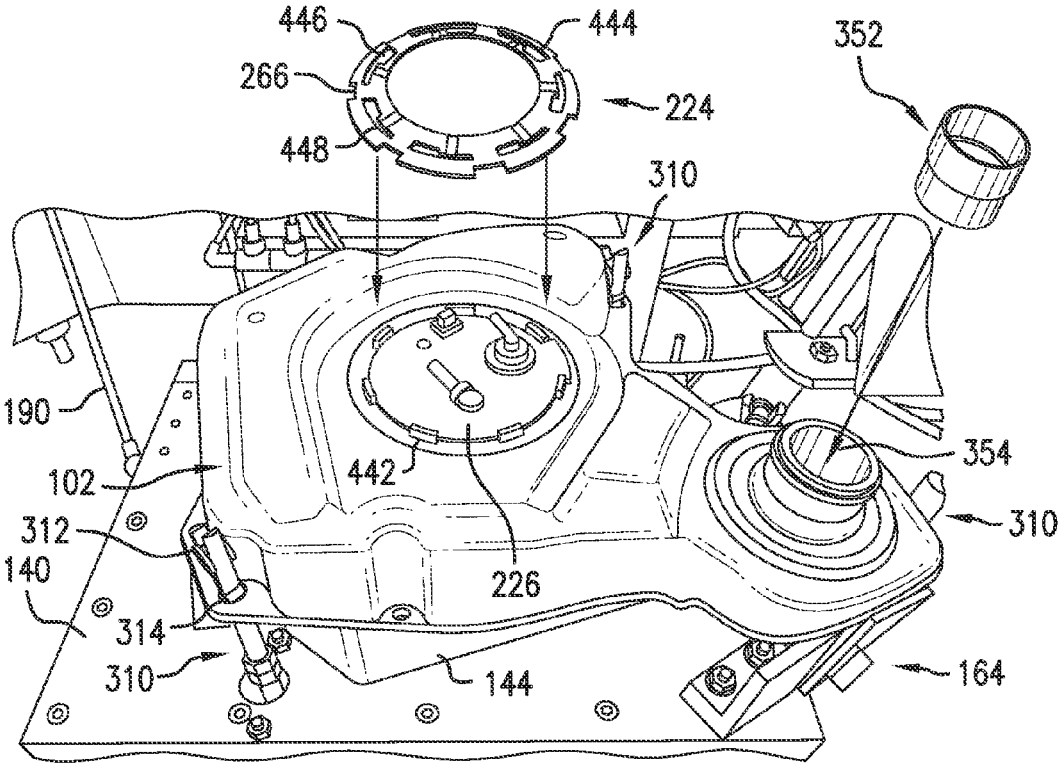
Figure 6F:
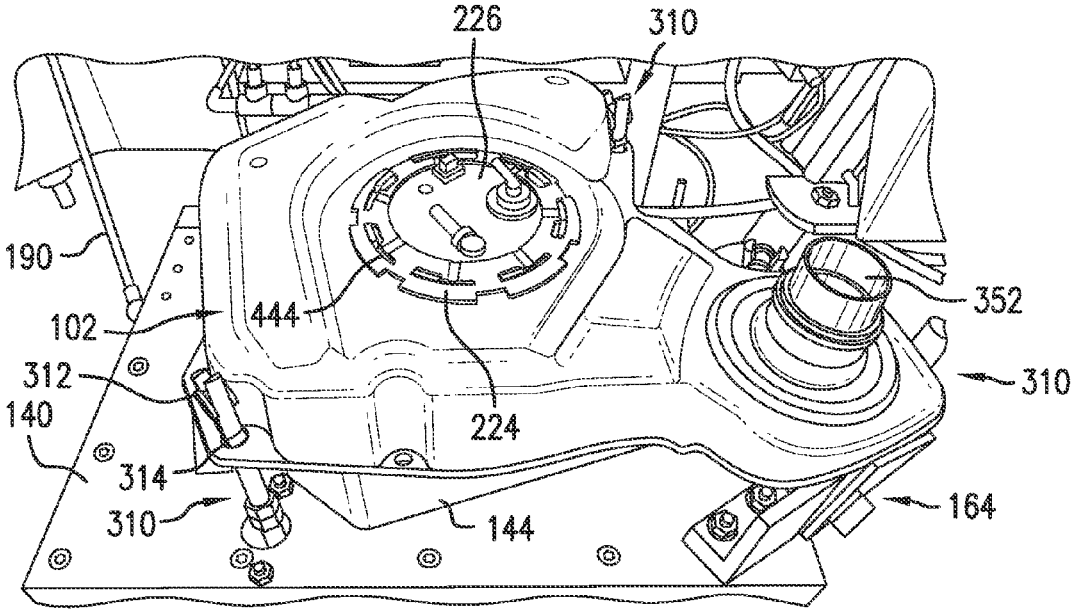

FIG. 6A depicts the fixture 100 prior to the fuel tank 102 being placed in the fuel tank locator 144. FIG. 6B depict the fuel tank 102 placed in the locator 144 which actuates the fuel tank indicator 152 and enables the first mechanical valve 400. As indicated previously, the adjustable supports 160 ensure that the locator 144 does not shift or move on the platform 140 during assembly of the fuel tank 102. The supports 160 also provide adjustability to precisely locate the lock ring cutouts 266 and the engagement members or pins 260, 262 on the lock cup 230 of the locking device 220. The grommet installers 310 are inserted through the mounting holes 314, and the grommets 312 are placed on the grommet installers 310. A seal or O-ring 440 is positioned around the fuel pump opening 228 (FIG. 6C) and the fuel pump 226 is then properly inserted in the fuel pump opening over the seal 440 (FIG. 6D). As shown, circumferentially spaced about the fuel pump opening 228 are locking tabs 442. The lock ring 224 includes slots 444 having an enlarged first section 446 and a second section 448. FIGS. 6E and 6F depict the locking ring 224 being placed around the fuel pump 226 and the locking tabs 442 are received in the first sections 446 of the slots 444. FIG. 6E also shows the plate level 352 being placed into the fuel cap opening 354.

With the components of the fuel tank 102 properly positioned thereon as illustrated in FIG. 6F, the lid 186 can then be automatically moved to its lowered position via the lid assist actuator 198. The lid 186 in its lowered position actuates the first mechanical valve 400. This allows an operator to press at least one of the cycle start buttons 428 to start the automatic operational functions of the fixture 100. According to one aspect, both cycle start buttons 428 have to be simultaneously pressed to actuate the fixture 100. Once in the lowered position, the lid lock mechanism 370 also moves to its locked position which actuates the second mechanical valve 410. Because the fuel tank 102 is properly positioned in the locator 144 via the grommet installers 310, the engagement members or pins 260, 262 on the lock cup 230 of the locking device 220 are received in the lock ring cutouts 266. With the second mechanical valve 410 actuated, a pneumatic signal is sent to the grommet installers 310, and the grommet installers 310 are retracted to pull the grommets 312 into the mounting holes 314. As indicated previously, retraction of the grommet installers 310 actuates the mechanical valve 332 of the installer indicator 330, which, in turn, send a pneumatic signal to the drive mechanism 270. The drive mechanism 270 is then actuated, and the first and second pistons 272, 274 rotate the lock cup 230 together with the lock ring 224. The stop mechanism 290 stops rotation of the lock cup 230 at its second position by cutting supply pressure to the first and second pistons 272, 274. The plate level installer 350 is then actuated to push the plate level 352 into the fuel cap opening 354. The plate level installer 350 stays in its extended position until the timer 434 stops, and then returns to its original retracted position. The timer 432 sends a pneumatic signal to the lid lock mechanism 370 to move back to its unlocked position. The lid 186 can then be automatically moved back to its raised position via the lid assist actuator 198 allowing the operator to confirm correct lock position of the lock ring installed on the fuel tank. The assembled fuel tank 102 is removed from the locator 144.

The present disclosure further provides a method of assembling a fuel tank 102 on a fixture 100. The method comprises placing the fuel tank 102 on the fuel tank locator 144 located on the fixture 100; placing the seal 440 around the fuel pump opening 228; inserting the fuel pump 226 into the fuel pump opening 228 located on a top wall of the fuel tank 102; positioning the lock ring 224 over both the inserted fuel pump and at least two locking tabs formed on the fuel tank 102 and circumferentially spaced about the fuel pump opening 228; positioning the locking device 220 of the fixture 100 over the lock ring, the locking device 220 having at least one engagement member 260, 262 for engaging a part of the lock ring; and automatically rotating the engagement member of the locking device 220 to move the lock ring 224 engaged thereto to a locked state on the fuel tank 102. As indicated previously, according to one aspect the engagement member is at least two spaced pins 260, 262 and the lock ring 224 includes at least two spaced slots. The pins are received in the slots upon positioning of the locking device 220 over the lock ring 224.

The exemplary method further comprises automatically stopping the drive mechanism 270 at a predetermined rotational position of the locking device to prevent the locking device 220 from over tightening the lock ring 224 on the fuel tank 102. The placing of the fuel tank step includes inserting the grommet installer 310 through the mounting hole 314 located on the fuel tank, and the method further comprises positioning the grommet 312 on the end portion of the grommet installer 310 extending through the mounting hole 314 and automatically retracting the grommet installer 310 from the mounting hole 314 to pull the grommet 312 into proper position in the mounting hole. As shown, the fuel tank 102 can include at least two mounting holes 314 and the insertion step includes inserting a grommet installer 310 in each of the mounting holes 314. The grommet installer 310 also properly positions the fuel tank 102 on the fuel tank locator 144. The exemplary method further comprises positioning the plate level 352 into the separate fuel cap opening 354 located on the fuel tank, and automatically pushing the plate level 352 in the fuel cap opening 354 with the plate level installer 350 mounted on the fixture 100 after moving of the lock ring 334 to its locked position on the fuel tank 102.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A portable fixture for assembling a vehicle fuel tank comprising:

a frame including a platform having a fuel tank locator mounted thereon for at least partially receiving and supporting an associated fuel tank for assembly;

a lid connected to the frame and movable between a raised position and a lowered position;

a locking device located on the lid and including a rotatable lock cup sized to at least partially fit over an associated lock ring and at least one engagement member for engaging a part of the associated lock ring for securing an associated fuel pump in the associated fuel tank, the locking device operable to automatically move from a first position to a second position for rotating the associated lock ring to a locked state; and a stop mechanism operably connected to the locking device to automatically stop movement of the locking device at the second position to prevent over tightening of the associated lock ring.

2. The fixture of claim 1, wherein the at least one engagement member is a first engagement member and a second engagement member spaced from the first engagement member, each of the first and second engagement members projecting outwardly from the lock cup in a direction parallel to a rotational axis defined by the lock cup.

3. The fixture of claim 2, further including a drive mechanism coupled to the locking device and operable to rotate the locking device, wherein the drive mechanism includes a first actuator and a separate second actuator, each of the first and second actuators being connected to the lock cup and having a first operational state and a second operational state, wherein when the first actuator is in one of its first and second operational states the second actuator is in the other of its first and second operational states.

4. The system of claim 3, wherein the first actuator is a first piston having a first piston arm connected to the lock cup and the second actuator is a second piston having a second piston arm connected to lock cup, and the first operational state of each of the first and second pistons is a retracted position of its respective piston arm and the second operational state of each of the first and second pistons is an extended position of its respective piston arm.

5. The fixture of claim 1, further including at least one retractable grommet installer located on the platform adjacent the fuel tank locator, the at least one grommet installer configured to automatically secure an associated grommet in an associated mounting hole of the associated fuel tank.

6. The fixture of claim 5, wherein the at least one grommet installer includes a first elongated member and a second elongated member telescopically received in the first member, an end portion of the second member configured to extend through the associated mounting hole and have the associated grommet mounted thereto.

7. The fixture of claim 5, wherein the at least one grommet installer includes a first retractable installer and a second retractable installer, the first and second installers defining a locating feature on the frame for properly positioning the associated fuel tank on the fuel tank locator.

8. The fixture of claim 1, further including an automated plate level installer mounted to the lid and movable between a retracted position and an extended position for pushing an associated plate level in proper position in an associated fuel cap opening of the associated fuel tank.

9. The fixture of claim 1, further including a lid lock mechanism operable to automatically lock the lid in the lowered position.

10. The fixture of claim 1, further including a lid assist assembly operable to automatically move the lid between the raised position and the lowered position.

11. A system for assembling a vehicle fuel tank comprising:

a fixture including a frame having a fuel tank locator mounted thereto, the fuel tank locator configured to receive a vehicle fuel tank in an unassembled condition;

a fuel pump inserted into a fuel pump opening located on the fuel tank;

a lock ring positioned over both the inserted fuel pump and at least two locking tabs formed on the fuel tank and circumferentially spaced about the fuel pump opening;

a locking device provided on the fixture and movable to a position over the lock ring, the locking device configured to engage the lock ring;

a drive mechanism coupled to the locking device and operable to move the locking device from a first position to a second position, movement of the locking device rotating the lock ring to a locked state on the fuel tank; and a stop mechanism operably connected to the drive mechanism and configured to automatically stop operation the drive mechanism when the locking device is in the second position to prevent the locking device from over tightening the lock ring on the fuel tank.

12. The system of claim 11, wherein the locking device includes a rotatable lock cup having a first engagement member and a second engagement member spaced from the first engagement member, each of the first and second engagement members projecting outwardly from the lock cup for engaging the lock ring, and the drive mechanism includes a first piston and a second piston, a piston arm of each of the first and second pistons being connected to the lock cup, actuation of the first and second pistons rotating the lock cup.

13. The system of claim 11, further including at least one grommet installer mounted to the frame, the at least one grommet installer extending through a mounting hole located on the fuel tank, the at least one grommet installer operable to automatically install a grommet in the mounting hole, wherein the at least one grommet installer includes a retractable elongated member, an end portion of the elongated member sized to be inserted through the mounting hole and adapted to have the grommet mounted thereon, wherein retracting the end portion of the at least one grommet installer from the mounting hole pulls the grommet into proper position in the mounting hole.

14. The system of claim 11, further including a plate level inserted into a separate fuel cap opening located on the fuel tank, and the fixture includes a plate level installer operable to automatically push the plate level in the fuel cap opening.

15. A method of assembling a fuel tank on a fixture comprising:

placing a fuel tank on a fuel tank locator located on the fixture, the fixture comprising:

a frame including a platform having the fuel tank locator mounted thereon;

a lid connected to the frame and movable between a raised position and a lowered position;

a locking device located on the lid and including a rotatable lock cup sized to at least partially fit over a lock ring and at least one engagement member for engaging a part of the lock ring for securing a fuel pump in the fuel tank, the locking device operable to automatically move from a first position to a second position for rotating the lock ring to a locked state; and a stop mechanism operably connected to the locking device to automatically stop movement of the locking device at the second position to prevent over tightening of the lock ring;

inserting the fuel pump into a fuel pump opening located on a top wall of the fuel tank;

positioning the lock ring over both the inserted fuel pump and at least two locking tabs formed on the fuel tank and circumferentially spaced about the fuel pump opening;

positioning the locking device of the fixture over the lock ring; and automatically rotating the lock cup of the locking device to move the lock ring engaged thereto to a locked state on the fuel tank.

16. The method of claim 15, wherein the engagement member is at least two spaced pins and the lock ring includes at least two spaced slots, the pins being received in the slots upon positioning of the locking device over the lock ring.

17. The method of claim 15, wherein the fixture further includes a drive mechanism for rotating the locking device, and the method further comprises automatically stopping the drive mechanism at a predetermined rotational position of the locking device to prevent the locking device from over tightening the lock ring on the fuel tank.

18. The method of claim 15, wherein the placing of the fuel tank step includes inserting a grommet installer located on the fixture through a mounting hole located on the fuel tank, and the method further comprises:

positioning a grommet on an end portion of the installer extending through the mounting hole; and automatically retracting the installer from the mounting hole to pull the grommet into proper position in the mounting hole.

19. The method of claim 18, wherein the fuel tank includes at least two mounting holes and the insertion step includes inserting an installer in each of the mounting holes, the installers properly positioning the fuel tank on the fuel tank locator.

20. The method of claim 15, further comprising positioning a plate level into a separate fuel cap opening located on the fuel tank; and automatically pushing the plate level in the fuel cap opening with a plate level installer mounted on the fixture after moving of the lock ring to its locked position on the fuel tank.

* * * * *